United States Patent [19]

Schwartz

[11] Patent Number: 4,998,630

[45] Date of Patent: Mar. 12, 1991

[54] ORGANIZED STORAGE FOR MISCELLANEOUS PARTS

[76] Inventor: Josephine M. Schwartz, 1642 Buckhorn La., Billings, Mont. 59105

[21] Appl. No.: 257,637

[22] Filed: Oct. 14, 1988

[51] Int. Cl.[5] ..... A47G 29/00

[52] U.S. Cl. ..... 211/71; 211/46; 211/162

[58] Field of Search ..... 211/71, 94.5, 94, 162, 211/46, 181, 194, 12, 59.2, 89; 248/95

[56] References Cited

U.S. PATENT DOCUMENTS

| | | | |
|---|---|---|---|
| 1,915,671 | 6/1933 | Hyer | 211/71 X |
| 2,031,147 | 2/1936 | Doolin | 211/71 X |
| 2,630,923 | 3/1953 | Makar | 211/71 |
| 2,864,511 | 12/1958 | Losey | 211/89 |
| 3,098,568 | 7/1963 | LaPierre | 211/181 X |
| 4,249,663 | 2/1981 | Hewlett | 211/12 X |
| 4,787,522 | 11/1988 | Nocek et al. | 211/71 |
| 4,793,495 | 12/1988 | Preu | 211/46 X |

*Primary Examiner*—Blair M. Johnson

[57] ABSTRACT

This invention is a storage device that economically, handily, and orderly stores miscellaneous parts such as would appear in homes, hobby shops, professional shops, laboratories, technical work places, offices, parts stores, and many other places. It is a means of attaching bags in a hanging position to the under side of any surface, including a shelf, cabinet, ceiling, work bench, and others, in such a manner that the bags are readily slid into and out of the attaching structure. It uses otherwise unused space and frees up the higher valued space that the cluster of drawers now occupy on the top of work benches, and shelves, and is far more durable and economical.

1 Claim, 3 Drawing Sheets

ORGANIZED STORAGE FOR MISCELLANEOUS PARTS

TECHNICAL FIELD

This invention relates to a novel storage device and more particularly to a handy, transparent, efficient, economical and durable apparatus for storing miscellaneous parts.

NEED FOR THIS INVENTION

This invention fills a need for inexpensive and orderly storage of miscellaneous parts and is needed many places including homes, hobby shops, professional shops, laboratories, technical work places, offices, parts stores, and many others.

BACKGROUND OF THIS INVENTION

In the past this need has been filled by the use of bins, drawers, boxes, bags, shelves, and the like. The said bins, drawers, and boxes have been adapted and fitted with various apparatus to organize them in stacks and rows, generally in a cluster to be placed on top of benches and shelves. When these clusters are placed on work benches, valuable work area is compromised. When they are placed on shelves space that is more valuable for other purposes is taken up.

SUMMARY OF THIS INVENTION

This invention is a means of attaching bags in a hanging position to the under side of any surface including a shelf, cabinet, ceiling, work bench, and others, in such a manner that the bags are readily slid into and out of the attaching structure. It allows for the use of otherwise generally unused space and frees up the higher valued space for higher priority service. It also produces a better, more convenient durable means.

Presently a popular method of storing miscellaneous small parts is the cluster of small drawers, in columns and rows in a cubical frame.

Although the drawers are made of transparent material, they are so close together, it is impossible to look into them from the top, bottom or sides to see the contents. The front panels are all that is exposed to see through and they are so small that they are very restrictive.

A label may be put on the face of the drawer but the allowable surface for such an attachment is so small that legability and variety are extremely limited. The most common methods of finding an article in this system is to open drawers one at a time and look inside, or laboriously keep a separate index.

The plastic material that most of the transparent drawers of the presently used clusters are made of, are by necessity made of stiff brittle material. During use they some times break. It is difficult to get a replacement because there are no standard spare parts marketed.

USEFULNESS OF THIS INVENTION

This invention uses low value space rather than the high value space.

The storage containers of this invention are suspended storage bags made of flexible, tough, plastic film and are very durable.

The storage containers of this invention are transparent and being suspended there contents are easily visible from all sides.

The supporting structure of this invention and the suspended bags are economically and handily manufactured from durable easily obtainable material including metal, or plastic sheets, or wire, or castings. Sufficient industrial and craft practices exist to facilitate manufacture of a practical and durable product.

Readers will find further advantages of this invention from consideration of the following description and the accompanying drawings.

DETAILED DESCRIPTION OF THE PREFERRED EMBODIMENT

This invention consists of a general assembly 11 made up of two major parts; a support structure 12, and a number of suspended storage bags 13.

Figure 1:
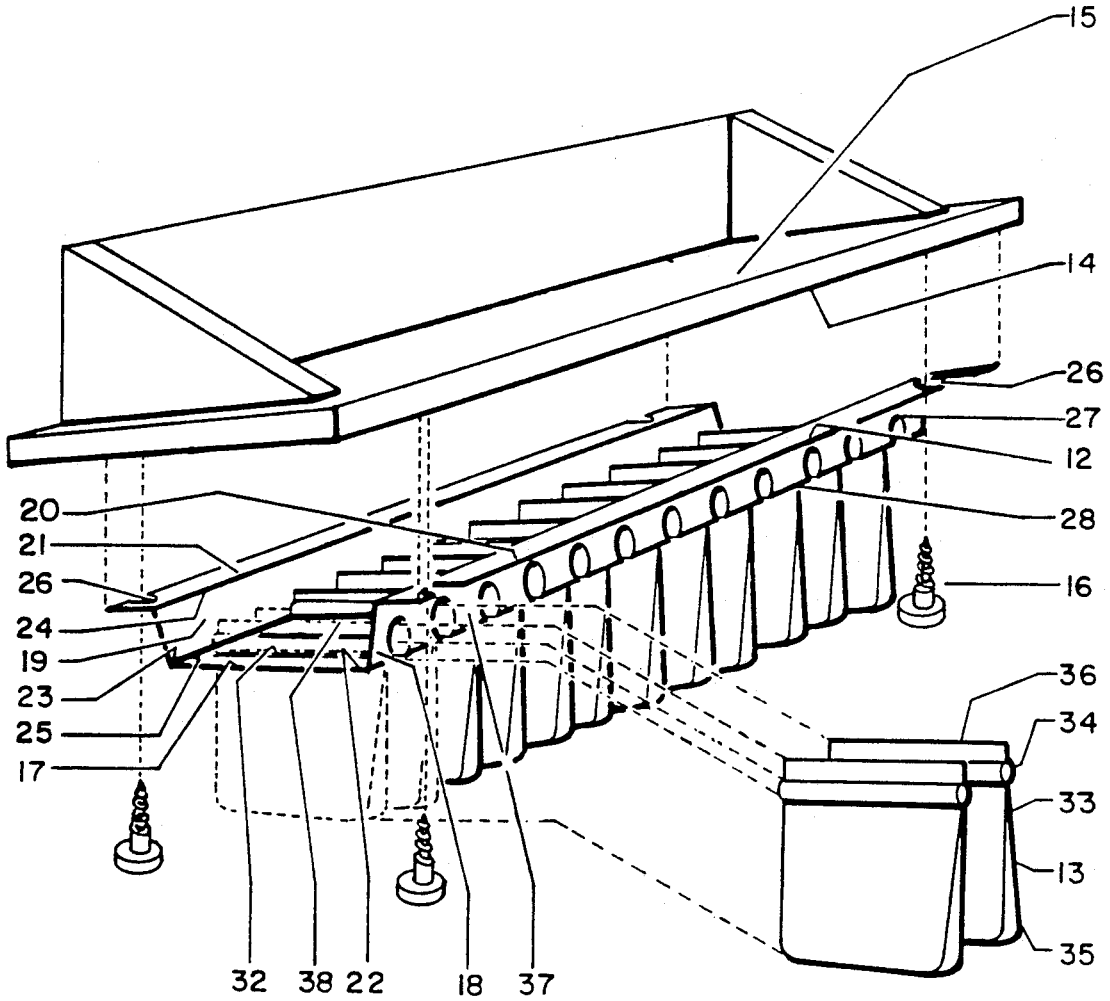
FIG. 1 is an exploded perspective drawing showing the preferred embodiment of this invention attached to the underside of an over hanging structure.

The said support structure 12 as illustrated in FIG. 1 is preferably attached to the under side 14 of an over hanging structure 15 employing a fastening means 16 which may be a screw, bolt, or other means. The said over hanging structure 15 of which the said under side 14 is a part of may be a shelf, cabinet, soffit, ceiling, work bench or other.

The said support structure 12 of this invention as illustrated in FIG. 1 can be made of many materials including sheet metal, or wire and can be coated with materials to resist corrosion and facilitate cleaning. The said support structure 12 can also be made of plastic or other material. For the purpose of description sheet metal material will be used in this specification.

The said support structure 12 of this invention as illustrated in FIG. 1 has a bottom side 17, a front side 18, a back side 19, a front flange 20, and a back flange 21. The said support structure has a resemblance to a structural steel channel. The said bottom side of the said support structure resembles the web of such a channel, and the said front side and back side of the said support structure resembles the flanges of the channel.

The said bottom side 17 of the said support structure 12, as illustrated in FIG. 1, occupies a horizontal plane. The said front side occupies another plane that intersects with that of the said bottom side forming an angle 22 that opens toward the back side. This angle is preferably slightly obtuse. The same is true of the back side 19 that occupies another plane that intersects with that of the said bottom side of the said support structure. This angle is also preferably slightly obtuse. These obtuse angles cause the channel shape of said support structure to be wider at its rim 24 than at its bottom 25 and facilitates one said support structure to nestle within another. This requires less space when more than one is stored or packaged together.

The front flange 20 and the back flange 21 being included in said support structure 12, as illustrated in FIG. 1, having a purpose of facilitating the attachment of said support structure to the under side 14 of an over hanging structure, is fitted with notches 26 along the edge of said flanges. Said notches being a means to accomodate fasteners, such as screws, bolts, or others, to the under side of an over hanging structure.

Normally the surface of the said front flange 20 and back flange 21 as illustrated in FIG. 1 are two separate surfaces, both in the same plane. This will accomodate the normal attachment to an over hanging structure 15, with an under side in a single plane. In the condition that the surface of the said underside is not of a single plane, the relationship of the surfaces of the said front flange 20 and back flange 21 must be adjusted to fit. This adjustment may be as complex as required.

The front side 18 as illustrated in FIG. 1 has a number of oblong holes 27 spaced across its length. These said oblong holes have there major axis perpendicular to the previously described horizontal plane that is occupied by the bottom side 17. The said major axis of these said oblong holes is great enough to allow the tops of the suspended storage bags to pass easily through without touching and without folding down. These suspended storage bags will be described in a later paragraph. These oblong holes also have a minor axis that is parallel to the previously described horizontal plane that is occupied by the said bottom side. The said minor axis of these oblong holes is great enough to allow the tops of the suspended storage bags to pass easily through without touching their sides.

The said oblong holes 27 as illustrated in FIG. 1 are disposed in such a manner that the lower part of there perimeter extends below the line of the intersection 28; of the front side 18 and the bottom side 17. The said line of intersection passes through the perimeter of the oblong holes at two points on each of there perimeters. The parts of the said lines of intersection between these pairs of points being within the oblong holes become gaps and are the large openings of converging guides centering on the narrow slots 32. These converging guides help direct the said thinner portion 33 of the suspended storage bags 13 into the narrow slots 32.

The said narrow slots 32 as illustrated in FIG. 1 being disposed along the bottom side 17 of the said support structure are of such a width that it will allow the insertion of the thinner portion 33 of the suspended storage bag 13 but will not allow the thicker portion 34, which resembles a bead at the top part of the said suspended storage bag to pass, causing it to hang freely. A description of the suspended storage bag is in a later paragraph. The said narrow slot is of sufficient length that the majority of the width of the said suspended storage bag may be inserted.

The suspended storage bag 13 of this invention as illustrated in FIG. 1 has a main part 35 manufactured of film or fabric which is thin, durable and flexible, and is joined on the sides and the bottom end in a monolithic manner, leaving the top end 36 open. The thicker portion 34 around this top opening supports the suspended storage bag after the thinner portion has been inserted 37 into the narrow slots of the support structure. The said thicker portion being above the thinner portion resides above 38 the narrow slots and resists gravitys effort to draw it through the said narrow slots while the said suspended storage bags are inserted into the said narrow slots their top ends are held closed by the narrow slots.

DESCRIPTION USING LESS PREFERRED BRACKETS

Figure 2:
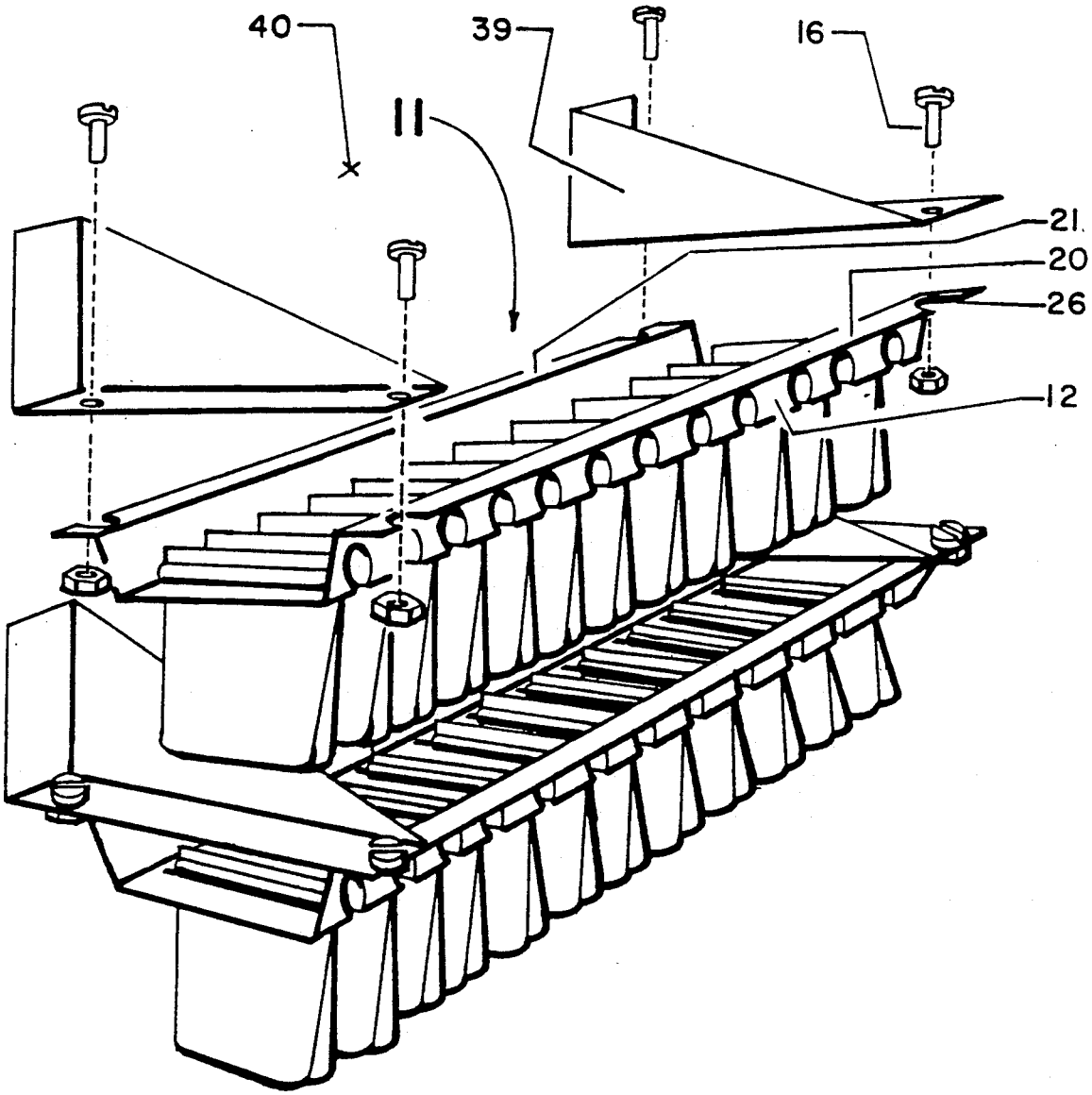
FIG. 2 is an exploded perspective drawing showing an embodiment of this invention attached to less preferred brackets.

Brackets 39 as illustrated in FIG. 2 are a less preferable substituted for the said over hanging structure. When secured to a vertical surface 40, brackets 39 may be attached to the said support structure 12 of the general assembly 11 by fastening means 16 which may be screws, bolts, or others. These said fastening means are accommodated by the said notches 26 that are along the edge of said front flange 20 and the back flange 21 of the said support structure 12.

Any number of said brackets 39 may be used with any number of said general assemblys 11 to form rows and columns on a vertical surface to create storage capacity of any magnitude needed.

Note that in FIG. 2 there is no design change required to the support structure 12 to adapt to the use of brackets.

DESCRIPTION USING LESS PREFERRED LEGS

Figure 3:
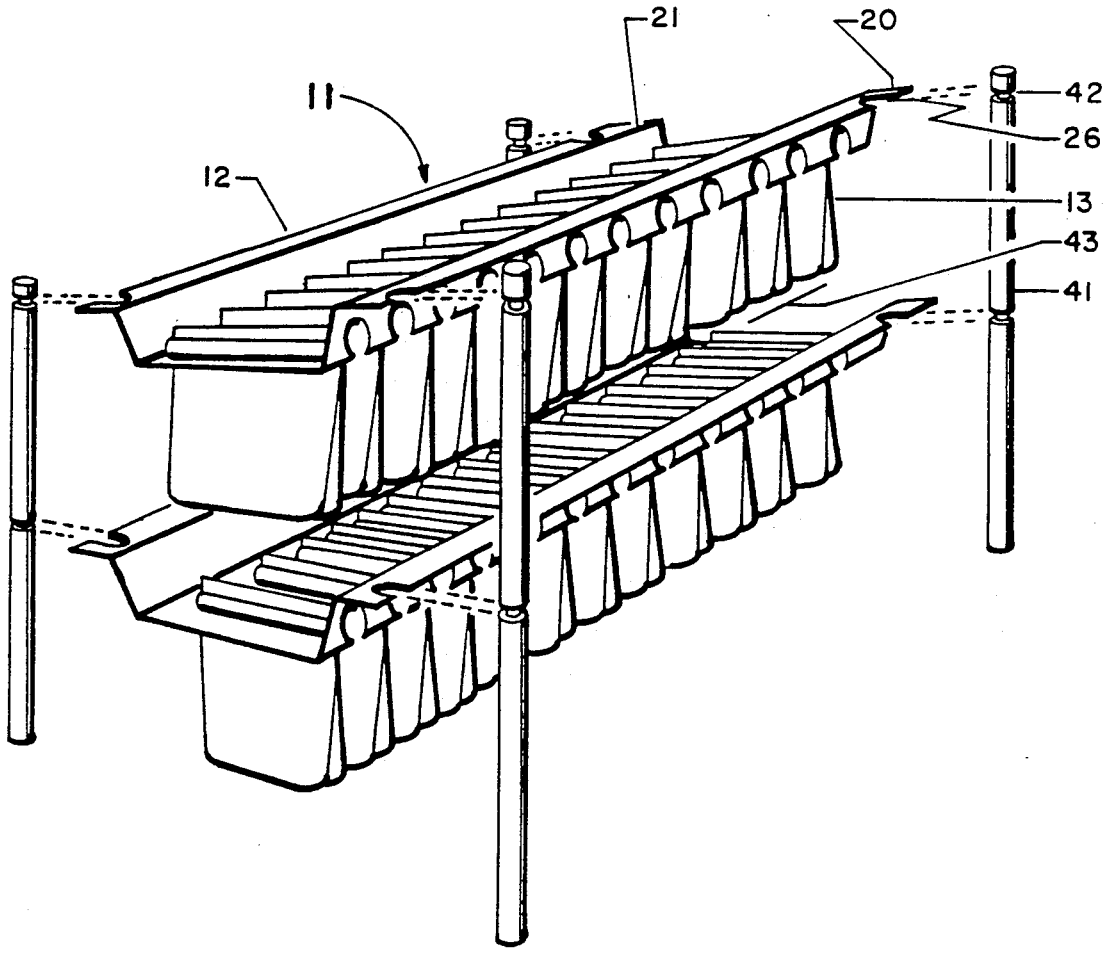
FIG. 3 is an exploded perspective drawing showing an embodiment of this invention attached to less preferred legs.

Legs 41 as illustrated in FIG. 3 are a less preferable substitute for the said over hanging structure. The said legs 41 are shaped with groovès 42 so that they are pressed into the said notches 26 that are along the edge of the said front flange 20 and back flange 21; they support the general assembly 11 in such a manner that the said suspended storage bags 13 hang freely 43. The said legs 41 are as long as may be required to support as many general assemblys 11 as are necessary for a given application.

Note that in FIG. 3 there is no design change required to the support structure 12 to adapt to the use of said legs.

The above descriptions and the accompanying drawings show that this invention provides a novel storage device, with features and advantages not found in previous storage devices.

This novel storage device can be handily manufactured using common methods and materials.

This novel storage device can normally be manufactured for much less cost than the drawers and bins now being used.

This novel storage device is an improvement over other storage devices in that it occupies space that is not normally used for other purposes.

This novel storage device is an improvement over other storage devices in being able to readily and easily see the contents of the suspended storage bag.

This novel storage device is an improvement over other storage devices in that the suspended storage bag is manufactured using a very tough, resilient, flexible, transparent plastic material while the clusters of drawers commonly being used are by necessity manufactured using ridgid, brittle plastic material.

This novel storage device is an improvement over other storage devices in that irregular shaped parts can be stored in the suspended storage bags, the support structure will not interfere with the resulting irregular shape of the suspended storage bag. The drawers and bins with there rigid shape and the confinement of the frame around them will not allow this.

It is apparent that various modifications in addition to those discussed above can be made in this novel storage device without changing the scope of this invention. The size, configuration, and arrangement of components can be changed to meet specific requirements, provided the functioning thereof is not adversely affected, therefore the scope of this invention is to be limited only by following claims.

What I claim is:

1. A storage device comprising, in combination:

a. a support structure, said support structure comprising a plurality of generally horizontal, parallel, downwardly opening channels, each channel having at least one open end, each opening being defined by a slot which is narrower than the crossectional dimension of said channel, said support structure having a mounting means for suspending said support structure from a generally horizontal mounting surface; and b. a plurality of storage bags, each of said storage bags having a main part which is thin and joined at lateral sides and at the bottom in a monolithic manner leaving the top end open, said open end having a thicker portion, a thinner portion being defined just below said thicker portion, whereby, said thicker portion is slidably inserted through said open end into said channel whereby said thinner portion extends through said slot wherein said bags are suspended from said support structure.

* * * * *